US012729547B2

(12) United States Patent
House et al.

(10) Patent No.: US 12,729,547 B2
(45) **Date of Patent: *Sep. 8, 2026**

(54) PRESSURE SENSITIVE ADHESIVE JOINT SUPPORT

(71) Applicant: CertainTeed Gypsum, Inc., Malvern, PA (US)

(72) Inventors: Michael House, Bend, OR (US); Stephen Cline, Bend, OR (US)

(73) Assignee: CertainTeed Gypsum, Inc., Malvern, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/656,828

(22) Filed: May 7, 2024

(65) Prior Publication Data

US 2024/0401346 A1 Dec. 5, 2024

Related U.S. Application Data

(63) Continuation of application No. 17/093,265, filed on Nov. 9, 2020, now Pat. No. 11,976,475.

(60) Provisional application No. 62/933,028, filed on Nov. 8, 2019.

(51) Int. Cl.
*E04F 21/00* (2006.01)
*E04F 21/165* (2006.01)

(52) U.S. Cl.
CPC ..... *E04F 21/0053* (2013.01); *E04F 21/1657* (2013.01)

(58) Field of Classification Search
CPC ..... E04F 21/0053; E04F 21/1657
USPC ..... 52/287.1
See application file for complete search history.

(56) References Cited

U.S. PATENT DOCUMENTS 290,750 A * 12/1883 Cunha ..... E04F 13/06 52/255
2,593,859 A * 4/1952 Dunlap ..... E04F 13/06 52/287.1
2,862,264 A * 12/1958 Perna ..... E04F 19/028 52/287.1

(Continued)

FOREIGN PATENT DOCUMENTS

CA 2004699 A1 6/1991
CA 2573324 A1 7/2008

(Continued)

*Primary Examiner* — James M Ference
(74) *Attorney, Agent, or Firm* — McDonnell Boehnen Hulbert & Berghoff LLP

(57) ABSTRACT

The present disclosure relates a joint support that includes a support strip having first and second elongate flanges, the first and second elongate flanges having an inside surface, an outside surface, an inner edge, and an outer edge. The joint support further includes a first auxiliary flap including an inner portion attached to the inside surface of the first elongate flange and an outer portion that extends laterally beyond the outer edge of the first elongate flange. The joint support further includes a second auxiliary flap including an inner portion attached to the inside surface of the second elongate flange and an outer portion that extends laterally beyond the outer edge of the second elongate flange. The joint support further includes a pressure sensitive adhesive substance disposed on at least a first portion of an inside surface of each of the first auxiliary flap and the second auxiliary flap.

21 Claims, 11 Drawing Sheets

(56) References Cited

U.S. PATENT DOCUMENTS 2,904,856 A * 9/1959 Robinson ..... E04F 13/06 52/255
3,255,561 A * 6/1966 Cable ..... E04F 13/06 52/717.06
3,643,393 A * 2/1972 Pierce ..... E04B 2/80 52/287.1
4,553,363 A * 11/1985 Weinar ..... E04F 19/06 52/718.04
4,722,153 A * 2/1988 Hardy ..... E04F 13/06 52/258
4,833,855 A * 5/1989 Winter, IV ..... E04C 2/288 52/591.4
4,835,925 A * 6/1989 Hoffmann, Sr. ..... E04F 13/06 52/287.1
4,876,837 A * 10/1989 Kelly ..... B21B 1/095 52/287.1
4,977,718 A * 12/1990 Hoffman, Sr. ..... E04F 19/028 52/287.1
5,045,374 A * 9/1991 Tucker ..... E04F 19/028 428/192
5,138,810 A * 8/1992 Kartler ..... E04F 13/06 52/255
5,344,681 A * 9/1994 Calhoun ..... C09J 7/20 428/354
5,442,886 A * 8/1995 Iacobelli ..... E04F 13/06 52/287.1
5,486,394 A 1/1996 Stough
5,593,759 A * 1/1997 Vargas ..... C09J 7/20 428/354
5,687,523 A 11/1997 Stough
5,711,124 A 1/1998 Stough
5,752,353 A * 5/1998 Koenig ..... E04F 13/06 52/287.1
5,778,617 A * 7/1998 Free ..... E04F 13/06 52/255
5,836,122 A 11/1998 Rennich
6,001,200 A * 12/1999 Hibler ..... E04F 13/042 156/212
6,073,406 A * 6/2000 Kearney ..... E04F 13/06 52/287.1
6,083,616 A * 7/2000 Dressler ..... C09J 7/385 428/323
6,131,348 A * 10/2000 Dunham ..... E04F 13/06 52/287.1
6,145,259 A 11/2000 Koenig, Jr.
6,221,484 B1 * 4/2001 Leiter ..... B32B 3/266 428/40.1
6,228,485 B1 * 5/2001 Leiter ..... B32B 3/266 428/40.1
D458,388 S * 6/2002 Harel ..... D25/119
6,447,872 B1 * 9/2002 Larson ..... E04F 13/06 52/287.1
6,502,358 B2 1/2003 Smythe, Jr.
6,539,680 B2 * 4/2003 Kunz ..... E04F 13/068 52/287.1
6,571,520 B2 * 6/2003 Koenig, Jr. ..... E04F 13/06 52/287.1
6,684,586 B1 2/2004 Hoffmann, Sr.
6,691,476 B1 * 2/2004 Kunz ..... E04F 13/06 52/287.1
6,722,092 B2 * 4/2004 Kunz ..... E04F 13/06 52/255
6,901,711 B2 6/2005 Fay
7,214,434 B2 * 5/2007 Dalgleish ..... E04F 13/042 162/164.1
8,910,437 B2 * 12/2014 Robertson ..... E04F 13/06 52/255
9,085,906 B2 * 7/2015 Ward ..... E04F 13/068
9,377,160 B1 * 6/2016 Smythe ..... E04F 13/06
9,388,582 B1 * 7/2016 Smythe ..... E04F 13/068
10,047,524 B2 8/2018 Smythe
10,100,528 B2 10/2018 Wambaugh
10,258,122 B2 4/2019 Bongiorno
10,458,122 B2 10/2019 Bodner
11,976,475 B2 * 5/2024 House ..... E04F 21/0053
2002/0035809 A1 * 3/2002 Smythe, Jr. ..... E04F 13/06 52/255
2002/0073638 A1 * 6/2002 Kunz ..... E04F 13/068 52/255
2002/0073639 A1 * 6/2002 Kunz ..... E04F 13/06 52/255
2002/0189747 A1 * 12/2002 Steinwender ..... E04F 15/04 156/304.1
2003/0033766 A1 * 2/2003 Smythe, Jr. ..... E04F 19/022 52/255
2003/0033770 A1 * 2/2003 Harel ..... E04F 13/068 52/287.1
2003/0056453 A1 3/2003 Young
2003/0131546 A1 * 7/2003 Kunz ..... E04F 13/068 52/255
2003/0181114 A1 9/2003 Newton
2004/0255537 A1 12/2004 Dalgleish
2005/0055963 A1 * 3/2005 Smythe, Jr. ..... E04F 13/06 52/716.1
2006/0070324 A1 * 4/2006 Daly ..... E04F 13/06 52/287.1
2006/0191237 A1 * 8/2006 Hansen ..... E04F 13/04 52/746.1
2006/0283115 A1 12/2006 Robertson
2007/0122593 A1 5/2007 Conboy
2008/0163584 A1 7/2008 Colucci
2010/0215900 A1 * 8/2010 Conboy ..... C09J 7/21 428/137
2010/0218445 A1 9/2010 Smythe
2010/0291351 A1 * 11/2010 Conboy ..... C09J 7/35 428/177
2011/0023392 A1 * 2/2011 Rosenthal ..... E04F 13/068 52/287.1
2011/0289873 A1 12/2011 Smythe, Jr.
2012/0324812 A1 12/2012 Robertson
2013/0045351 A1 2/2013 Spanton
2013/0145706 A1 6/2013 Norton
2013/0186024 A1 * 7/2013 Rosentiel ..... E04F 13/06 52/255
2014/0123581 A1 * 5/2014 Ward ..... E04F 19/022 52/287.1
2014/0260019 A1 9/2014 Conboy
2015/0068142 A1 3/2015 Smythe, Jr.
2015/0075093 A1 * 3/2015 Grant ..... E04F 13/22 52/255
2015/0259929 A1 * 9/2015 Koenig, Jr. ..... E04F 19/022 52/287.1
2016/0186019 A1 6/2016 Negri
2016/0289974 A1 * 10/2016 Smythe ..... E04F 19/028
2016/0362896 A1 * 12/2016 Wambaugh ..... E04F 13/068
2017/0018156 A1 1/2017 Kim
2017/0066946 A1 3/2017 Moyer, Jr.
2017/0081562 A1 3/2017 Rosenthal
2017/0138058 A1 5/2017 Swartz
2017/0314274 A1 11/2017 Rosenthal
2017/0314275 A1 * 11/2017 Rosenthal ..... C09J 5/06
2017/0335569 A1 11/2017 Kruger
2018/0171646 A1 6/2018 Stahl
2020/0010733 A1 1/2020 Hulteen
2021/0079273 A1 3/2021 Kamath
2021/0140179 A1 5/2021 House
2024/0401346 A1 * 12/2024 House ..... E04F 21/1657

FOREIGN PATENT DOCUMENTS

DE 202018100286 U1 1/2018
GB 2556161 A 5/2018
JP 2012036662 A 2/2012
JP 2014080855 A 5/2014
JP 3202989 U 3/2016
JP 2017002572 A 1/2017
WO 2018039726 A1 3/2018

* cited by examiner

PRESSURE SENSITIVE ADHESIVE JOINT SUPPORT

CROSS-REFERENCE TO RELATED APPLICATIONS

This application is a continuation of U.S. patent application Ser. No. 17/093,265, filed Nov. 9, 2020, which claims the benefit of priority of U.S. Provisional Patent Application No. 62/933,028, filed Nov. 8, 2019, each of which is hereby incorporated herein by reference in its entirety.

BACKGROUND OF THE DISCLOSURE

1. Field of the Disclosure

The present disclosure relates generally to building surface joint supports, for example, suitable for covering a seam between two building surface panels.

2. Technical Background

Building surface panels, such as drywall panels, are commonly used to create walls, ceilings, and other building surfaces in homes, businesses and other buildings. The panels are typically attached to a frame that holds the panels in place. Often, the edges between the panels are covered in order to create a smooth surface from one panel to the next. For example, in many instances, the joints or seams between adjacent panels are covered with a joint compound that is shaped to form a flat surface or clean corner at the joint. To strengthen the joint, the neighboring panels can be secured with a joint support, such as joint tape or a corner bead. The joint support aids in both securing the surface between the two panels, and in providing the desired shape at the seam.

Typical methods of installing a joint support include applying a preliminary layer of joint compound and fastening the joint support to the preliminary layer of joint compound. However, this method requires waiting for the first layer of joint compound to dry before moving on to subsequent steps. In some cases, the builder must wait up to 24 hours or longer before advancing to a subsequent step in the construction process. Other methods of installing joint supports use mechanical fasteners to attach the joint support to the building surface panels. For example, conventional metal corner beads are often attached to building surface panels using screws. This process is time consuming and requires the use of a specific tool. Moreover, it can require specific expertise to adequately obscure the mechanical fasteners after the building surface is completed. Accordingly, the present inventors have determined that a joint support that can be installed more easily and efficiently would be attractive to builders and customers.

SUMMARY OF THE DISCLOSURE

The present disclosure relates generally to building surface joint supports, for example, suitable for covering a seam between two building surface panels.

In one aspect, the present disclosure provides a joint support comprising:

a support strip having a length that extends from a first end to a second end, the support strip comprising:

first and second elongate flanges, each of the first and second elongate flanges extending from the first end to the second end and having an inside surface, an outside surface, an inner edge, and an outer edge;

a first auxiliary flap including an inner portion attached to the inside surface of the first elongate flange and an outer portion that extends laterally beyond the outer edge of the first elongate flange;

a facing sheet disposed on the outside surface of the first elongate flange and the outside surface of the second elongate flange; and a pressure sensitive adhesive substance disposed on at least a first portion of an inside surface of the first auxiliary flap.

In another aspect, the disclosure provides a building surface construction using the joint support of the disclosure, the building surface construction comprising:

a first building surface panel;

a second building surface panel adjacent to the first building surface panel so as to form a seam between the first building surface panel and the second building surface panel; and the joint support disposed over the first building surface panel and the second building surface panel and covering at least a portion of the seam, wherein the pressure sensitive adhesive substance secures the joint support to the first and second building surface panels.

In another aspect, the disclosure provides a method of installing the joint support of the disclosure so as to form a building surface construction according to the disclosure, the method comprising:

placing the joint support over the first building surface panel and the second building surface panel so as to cover at least a portion of a seam between the first and second building surface panels, wherein the inside surface of the first auxiliary flap is adjacent to an outside surface of the first building surface panel, and wherein the inside surface of the second auxiliary flap is adjacent to an outside surface of the second building surface panel;

applying a stimulus to the joint support in order to secure the joint support to the first and second building surface panels using the pressure sensitive adhesive.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have noted that conventional joint supports, such as corner beads, are time consuming to install. The present inventors have determined that a joint support that can be installed quickly and without the need for a preliminary layer of joint compound or mechanical fasteners would be attractive to builders.

Accordingly, one aspect of the disclosure is a joint support including a support strip, a first auxiliary flap, a facing sheet, and a pressure sensitive adhesive substance. The support strip has a length that extends from a first end to a second end. The support strip includes first and second elongate flanges. Each of the first and second elongate flanges extends from the first end to the second end and has an inside surface, an outside surface, an inner edge, and an outer edge. The first auxiliary flap includes an inner portion attached to the inside surface of the first elongate flange and an outer portion that extends laterally beyond the outer edge of the first elongate flange. The facing sheet is disposed on the outside surface of the first elongate flange and the outside surface of the second elongate flange. The pressure sensitive adhesive substance is disposed on at least a first portion of an inside surface of the first auxiliary flap.

Figure 1A:
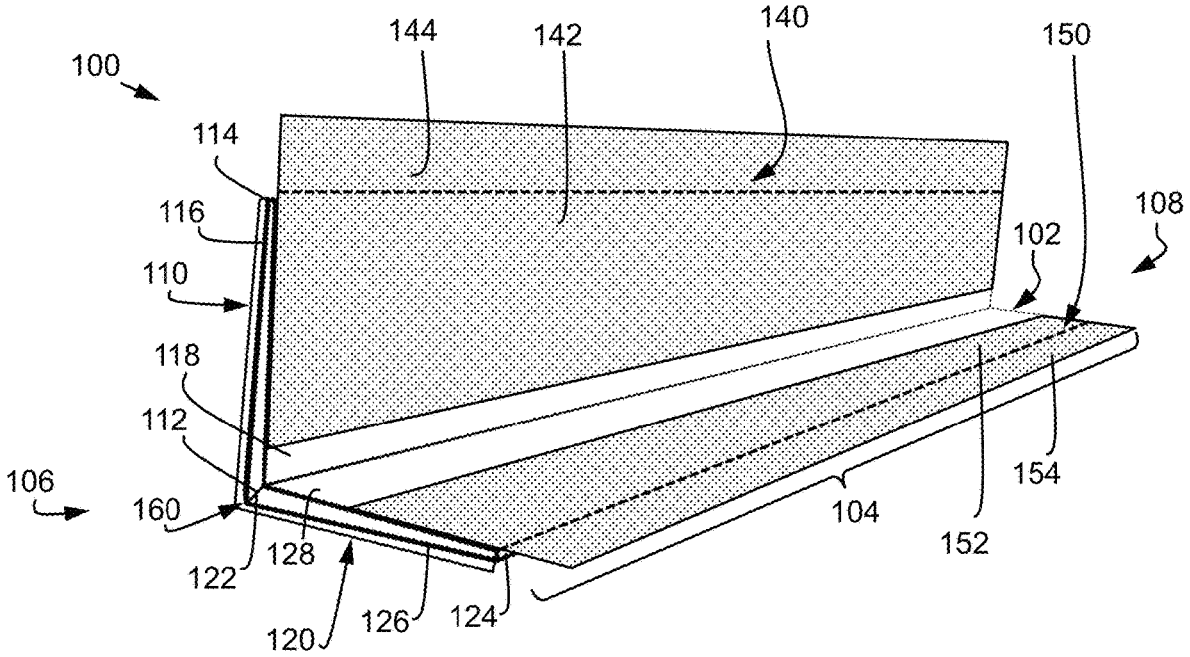
FIG. 1A is a schematic perspective view of a joint support according to an embodiment of the disclosure.
Figure 1B:
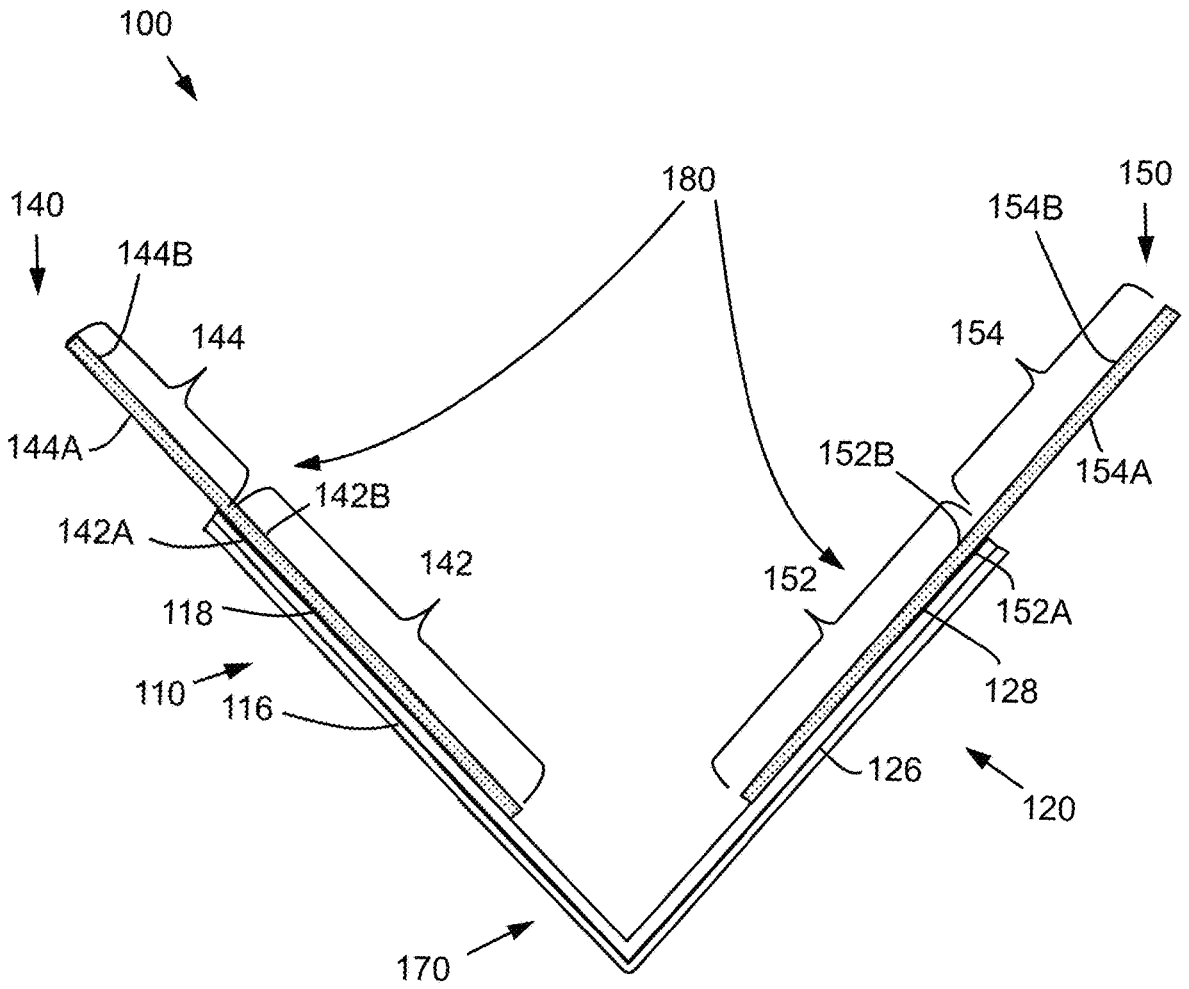
FIG. 1B is a schematic end view of the joint support of FIG. 1A.

Such a joint support is shown in perspective view in FIGS. 1A and 1B. As shown in FIG. 1A, joint support 100 includes support strip 102 that has length 104, first end 106 and second end 108. Length 104 is the largest dimension of support strip 102 and is substantially greater than the width or breadth of support strip 102. Further, first end 106 and second end 108 are defined with respect to length 104. Support strip 102 includes first elongate flange 110 and second elongate flange 120. First elongate flange 110 has inner edge 112, outer edge 114, outside surface 116, and inside surface 118. Similarly, second elongate flange 120 has inner edge 122, outer edge 124, outside surface 126, and inside surface 128. Notably, inside surface 118 and inside surface 128 are elements of joint support 100 that face towards a building surface whereas outside surface 116 and outside surface 126 are elements of joint support 100 that face away from a building surface (e.g., face the interior of a room). Furthermore, inner edge 112 and inner edge 122 are elements of joint support 100 that are proximate to a center of joint support 100 whereas outer edge 114 and outer edge 124 are elements of joint support 100 that are at distal areas of joint support 100.

Joint support 100 also includes first auxiliary flap 140 and second auxiliary flap 150. First auxiliary flap 140 includes inner portion 142 and outer portion 144. The demarcation between inner portion 142 and outer portion 144 is conceptually illustrated by the dashed line on first auxiliary flap 140. Inner portion 142 of first auxiliary flap 140 is attached to inside surface 118 of first elongate flange 110 whereas outer portion 144 of first auxiliary flap 140 extends laterally beyond outer edge 114 of first elongate flange 110. Similarly, second auxiliary flap 150 includes inner portion 152 and outer portion 154. The demarcation between inner portion 152 and outer portion 154 is conceptually illustrated by the dashed line on second auxiliary flap 150. Inner portion 152 of second auxiliary flap 150 is attached to inside surface 128 of second elongate flange 120 whereas outer portion 154 of second auxiliary flap 150 extends laterally beyond outer edge 124 of second elongate flange 120.

As shown in the schematic end view of joint support 100 provided in FIG. 1B, inner portion 142 of first auxiliary flap 140 includes outside surface 142A and inside surface 142B while outer portion 144 of first auxiliary flap 140 includes outside surface 144A and inside surface 144B. Outside surface 142A of first auxiliary flap 140 is attached to inside surface 118 of first elongate flange 110. Likewise, inner portion 152 of second auxiliary flap 150 includes outside surface 152A and inside surface 152B. Further, outer portion 154 of second auxiliary flap 150 includes outside surface 154A and inside surface 154B. Outside surface 152A of second auxiliary flap 150 is attached to inside surface 128 of second elongate flange 120. Notably, upon installation of joint support 100 over a building surface, inside surface 142B, inside surface 144B, inside surface 152B, and inside surface 154B will each face towards a building surface. On the other hand, outside surface 142A, outside surface 144A, outside surface 152A, and outside surface 154A will each face away from the building surface upon installation and will be exposed (e.g., to face the interior of a room). Accordingly, as explained in more detail below, the outside surfaces may be configured to receive a covering layer of joint compound or tape.

Additionally, facing sheet 170 is attached to outside surface 116 of first elongate flange 110 and outside surface 126 of second elongate flange 120. Such a facing sheet can provide a smooth transition from the joint support to the building surface panel so as to minimize the visibility of the edge of the joint support. Moreover, the facing sheet can also enhance adhesion of a joint compound to the joint support.

Further, joint support 100 includes pressure sensitive adhesive substance 180 disposed on at least a first portion of the inside surface of first auxiliary flap 140 and second auxiliary flap 150. As used herein, the term pressure sensitive adhesive substance, refers to materials that assist in adhering a joint support to a building surface. In particular, a pressure sensitive adhesive substance allows the joint support to be conveniently attached to building surface panels without a layer of joint compound between the joint support and the panels. Accordingly, subsequent steps in the construction of the building surface can be carried out as soon as the adhesive is adhered to the building surface, and without the need to wait for a layer of joint compound to dry. Furthermore, the pressure sensitive adhesive substance also allows the joint support to be installed without requiring metal fasteners, which can lead to increased efficiency in the installation.

In certain embodiments of the joint support as otherwise described herein, the joint support includes a second auxiliary flap including an inner portion attached to the inside surface of the second elongate flange and an outer portion that extends laterally beyond the outer edge of the second elongate flange, and the pressure sensitive adhesive substance is disposed on at least a portion of an inside surface of the second auxiliary flap.

Figure 2:
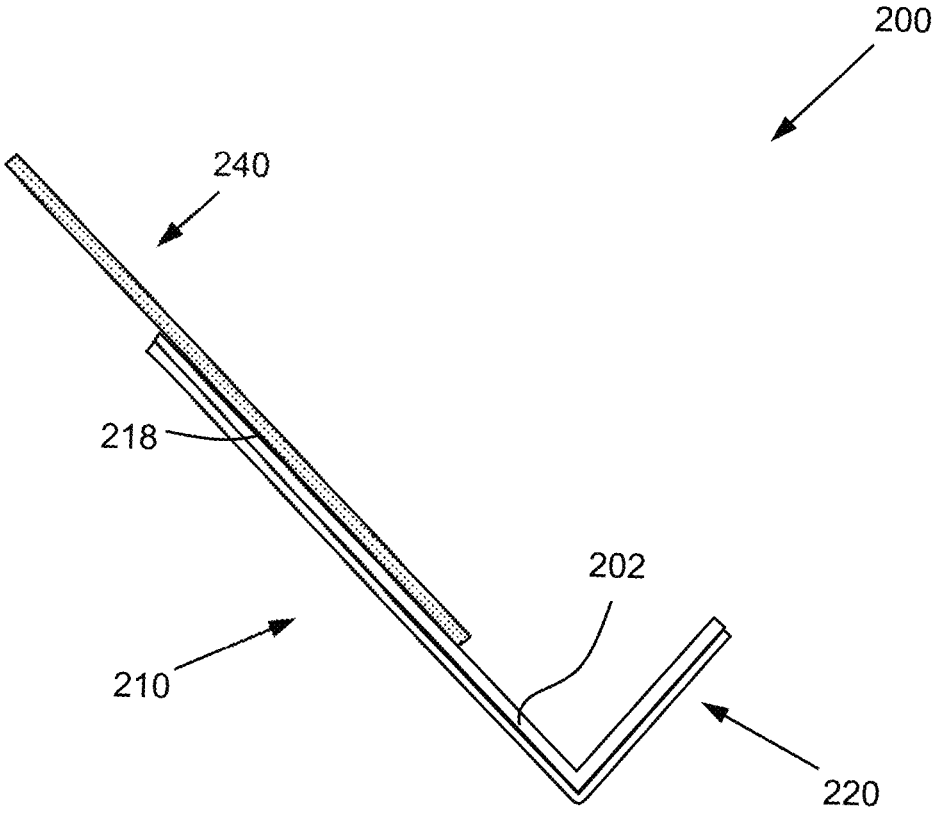
FIG. 2 is a schematic end view of a joint support according to another embodiment of the disclosure.

For example, joint support 100 includes first auxiliary flap 140 attached to inside surface 118 of first elongate flange 110 and second auxiliary flap 150 attached to inside surface 128 of second elongate flange 120, as described above. In other embodiments, the joint support includes only a first auxiliary flap attached to the first elongate flange without a second auxiliary flap attached to the second elongate flange. Such an embodiment is shown in FIG. 2. Joint support 200 is in the form of L-Trim and includes a first elongate flange 210 and a second elongate flange 220. The second elongate flange 220 is substantially narrower than first elongate flange 210 such that the support strip 202 has an asymmetrical configuration. A first auxiliary flap 240 is secured to the inside surface 218 of first elongate flange 210, but no auxiliary flap is secured to second elongate flange 220. Further still, in some embodiments, a first auxiliary flap is secured to the inside surface of the first elongate flange and extends beyond the outer edge of the first elongate flange while another layer is secured to the inside surface of the second elongate flange but does not extend beyond the outer edge of the second elongate flange.

In certain embodiments of the joint support as otherwise described herein, the support strip includes a corner connecting the first elongate flange and the second elongate flange. For example, as shown in FIG. 1A, support strip 102 of joint support 100 includes corner 160 connecting first elongate flange 110 and second elongate flange 120.

Figure 3:
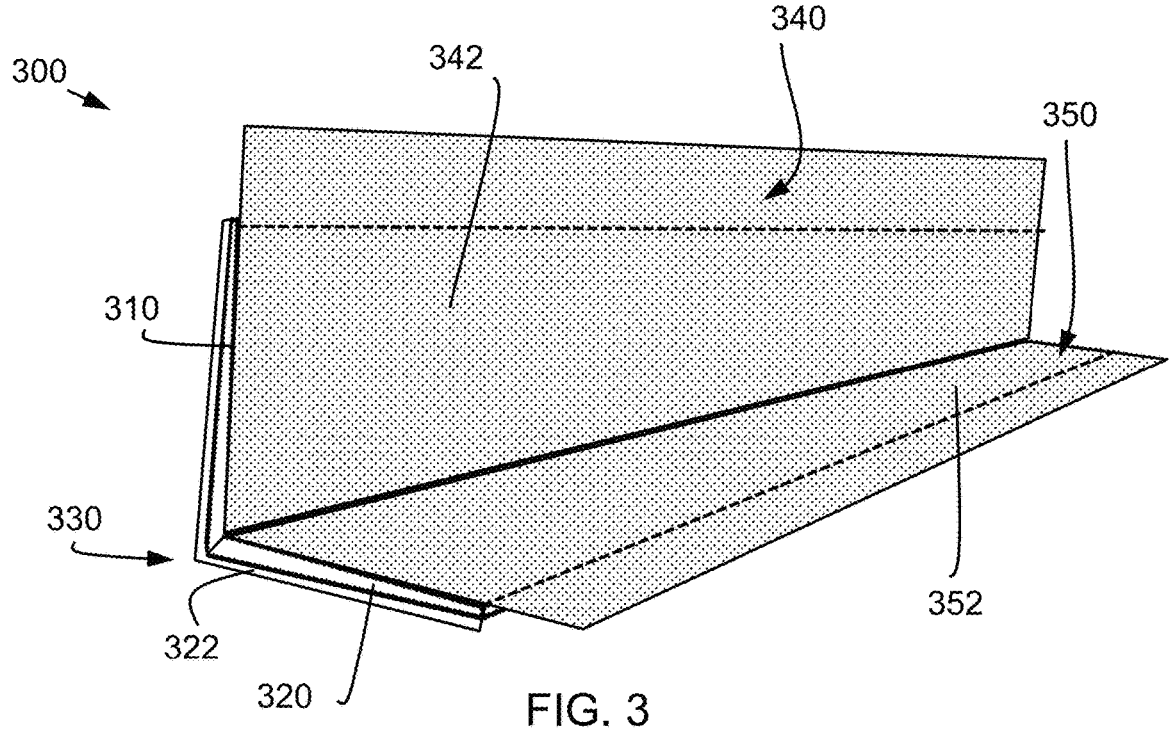
FIG. 3 is a schematic perspective view of a joint support according to another embodiment of the disclosure.

In certain embodiments of the joint support as otherwise described herein, the inner portion of the first auxiliary flap and the inner portion of the second auxiliary flap connect at the corner. Such a joint support is shown in FIG. 3. Joint support 300 includes a support strip having first elongate flange 310 and second elongate flange 320. First auxiliary flap 340 is attached to the inside surface of first elongate flange 310 and second auxiliary flap 350 is attached to the inside surface of second elongate flange 320. Facing sheet 322 is disposed on the outside surfaces of first elongate flange 310 and second elongate flange 320. Furthermore, inner portion 342 of first auxiliary flap 340 and inner portion 352 of second auxiliary flap 350 respectively extend over the inside surface of first elongate flange 310 and the inside surface of second elongate flange 320 so as to connect at corner 330. As such, the arrangement illustrated in FIG. 3 allows the first auxiliary flap and the second auxiliary flap to cover a greater surface area of the joint support.

Figure 4:
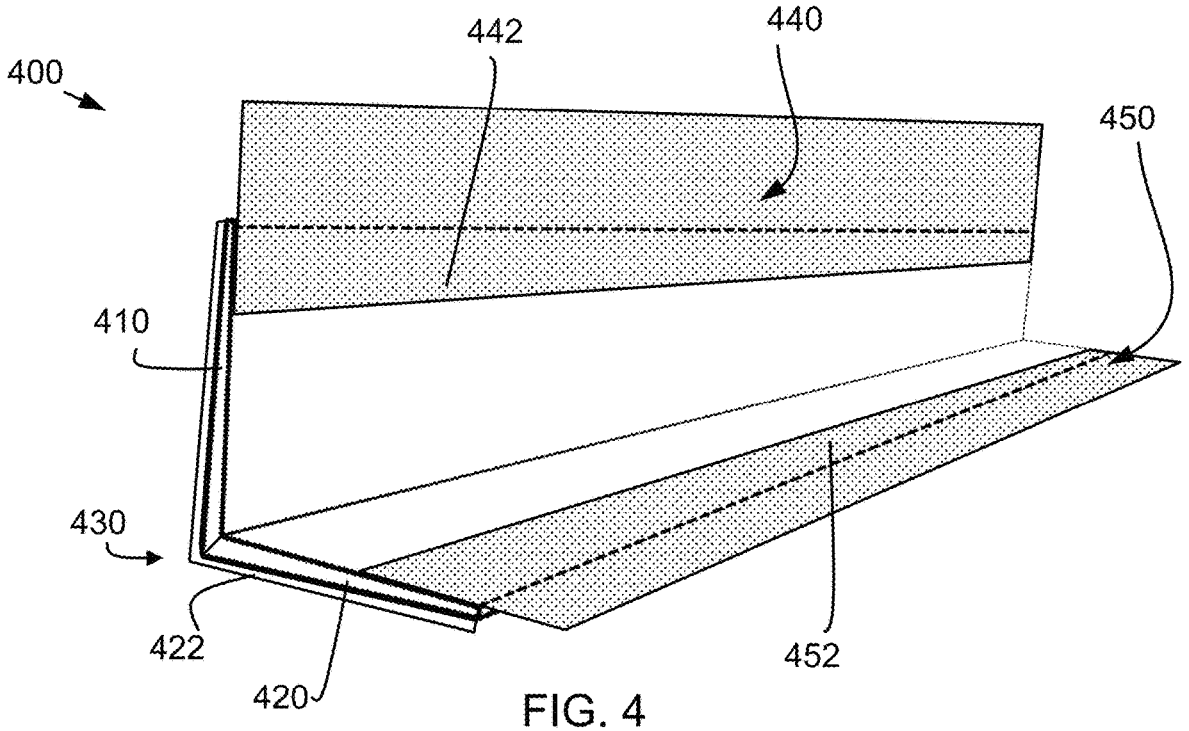
FIG. 4 is a schematic perspective view of a joint support according to yet another embodiment of the disclosure.

In certain embodiments of the joint support as otherwise described herein, the inner portion of the first auxiliary flap is spaced at least 1 inch from the corner, and the inner portion of the second auxiliary flap is spaced at least 1 inch from the corner. Such a joint support is shown in FIG. 4. Joint support 400 includes a support strip having first elongate flange 410 and second elongate flange 420. First auxiliary flap 440 is attached to the inside surface of first elongate flange 410 and second auxiliary flap 450 is attached to the inside surface of second elongate flange 420. Facing sheet 422 is disposed on the outside surfaces of first elongate flange 410 and second elongate flange 420. Furthermore, inner portion 442 of first auxiliary flap 440 and inner portion 452 of second auxiliary flap 450 are respectively attached to portions of the inside surface of first elongate flange 410 and the inside surface of second elongate flange 420 that are spaced at least 1 inch away (or alternatively spaced at least 0.25 inches, 0.5 inches, 2 inches, or 3 inches away) from corner 430. As such, the arrangement illustrated in FIG. 4 allows the first auxiliary flap and the second auxiliary flap to cover a smaller surface area of the joint support, thus saving on the amount of materials needed to manufacture the first auxiliary flap and the second auxiliary flap.

Figure 5:
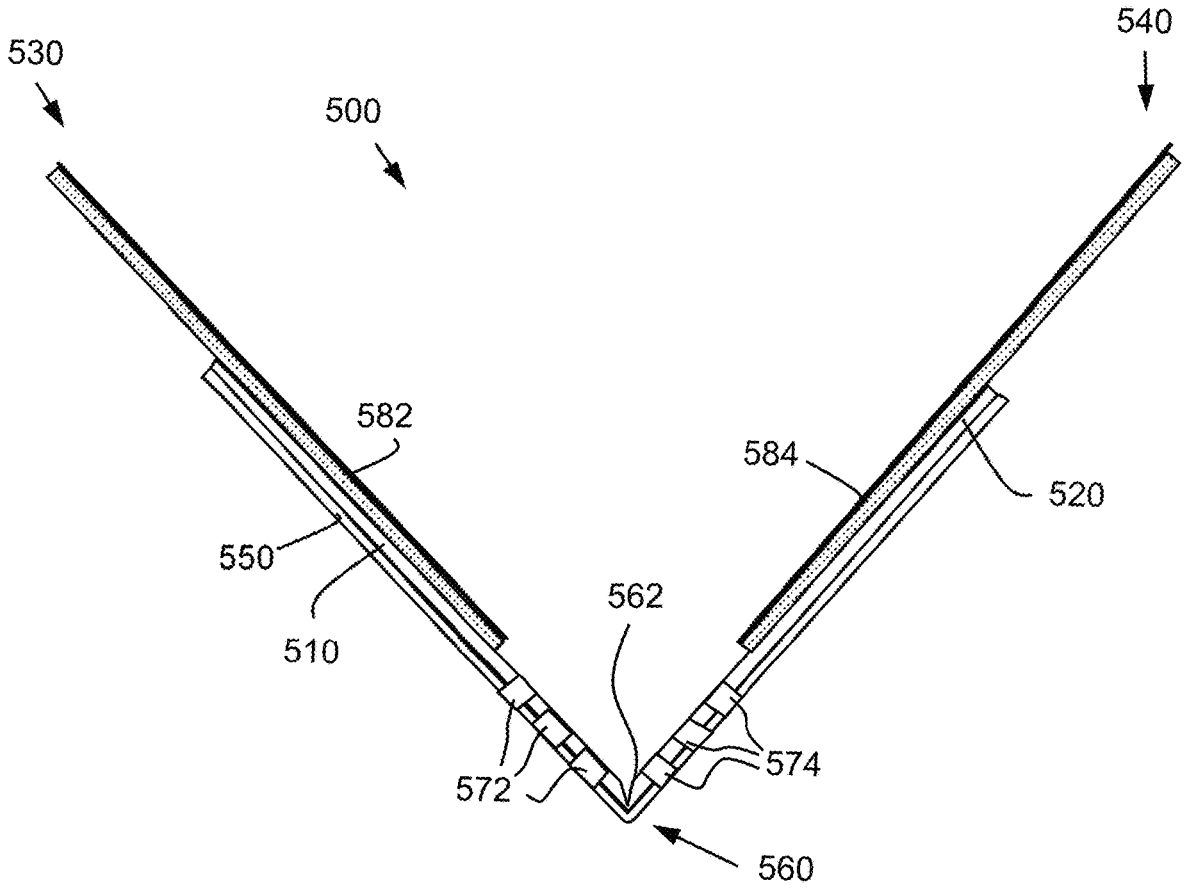
FIG. 5 is a schematic end view of a joint support according to another embodiment of the disclosure.

In certain embodiments of the joint support as otherwise described herein, the corner is a sharp corner that connects the first elongate flange to the second elongate flange and a groove is disposed on an inside surface of the sharp corner. Such a joint support is shown in FIG. 5. Joint support 500 includes first elongate flange 510, second elongate flange 520, first auxiliary flap 530 attached to first elongate flange 510, second auxiliary flap 540 attached to second elongate flange 520, and facing sheet 550. First elongate flange 510 and second elongate flange 520 are connected by sharp corner 560. Sharp corner 560 provides a clean sharp corner edge where joint support 500 covers the seam between the building surface panels. Groove 562 is disposed on the inside surface of sharp corner 560. Groove 562 allows first elongate flange 510 and second elongate flange 520 to flex with respect to one another as the joint support is placed over the corner formed by the adjacent building surface panels. This allows joint support 500 to be operable with a range of angles between two building surface panels.

Figure 6:
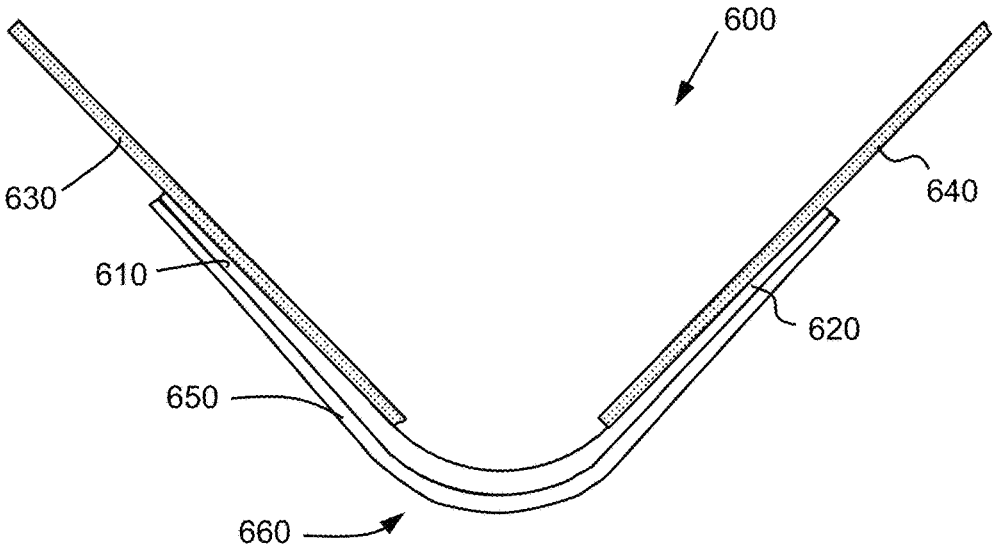
FIG. 6 is a schematic end view of a joint support according to still another embodiment of the disclosure.

In certain embodiments of the joint support as otherwise described herein, the corner is a rounded corner connecting the first elongate flange and the second elongate flange so as to form a bull-nose corner bead. Such a joint support is shown in FIG. 6. Joint support 600 includes first elongate flange 610, second elongate flange 620, first auxiliary flap 630, second auxiliary flap 640, and facing sheet 650. Further, first and second elongate flanges 610, 620 are connected to one another by a rounded corner 660, such that joint support 600 is constructed as a corner bead with a bull nose configuration. Rounded corner 660 of joint support 600 allows a uniform round edge to be provided at the seam between two building surface panels that are disposed at an angle to one another.

Figure 7:
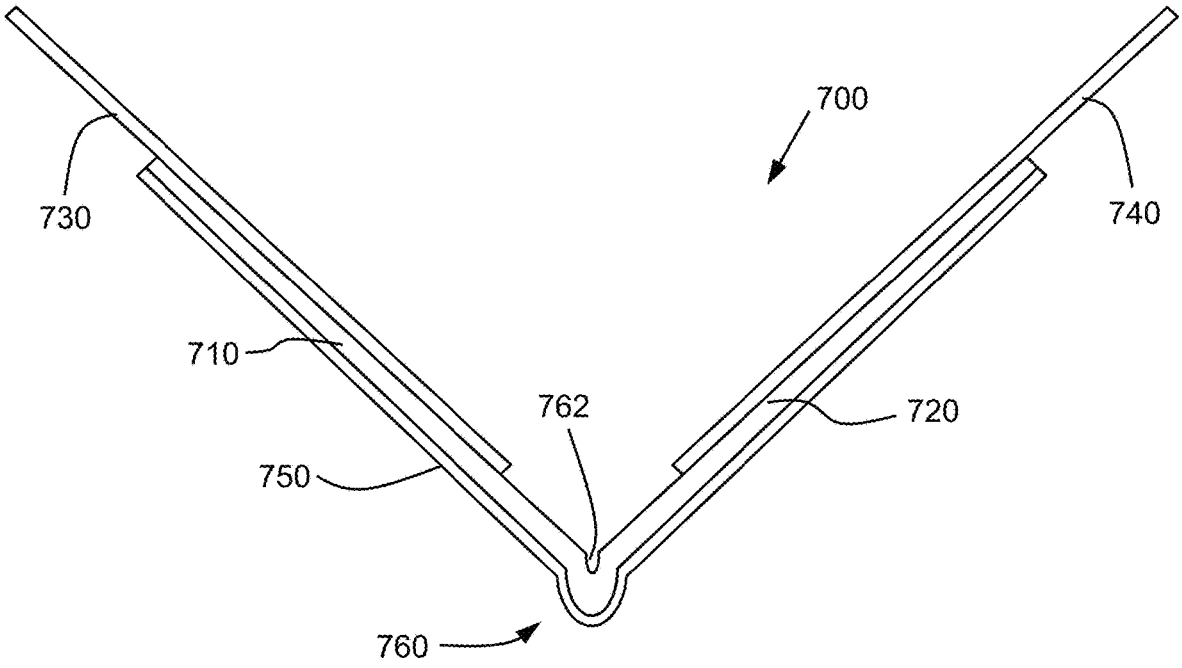
FIG. 7 is a schematic end view of a joint support according to yet another embodiment of the disclosure.

In certain embodiments of the joint support as otherwise described herein, the joint support includes a beaded corner connecting the first elongate flange and the second elongate flange. Such a joint support is shown in FIG. 7. Joint support 700 includes first elongate flange 710, second elongate flange 720, first auxiliary flap 730 attached to first elongate flange 710, second auxiliary flap 740 attached to second elongate flange 720, and facing sheet 750. First elongate flange 710 and second elongate flange 720 are connected by a corner that includes a beaded corner 760. Beaded corner 760 provides an outwardly projecting corner edge where joint support 700 covers the seam between the building surface panels. Groove 762 is disposed on the inside surface of sharp corner 760. The projection formed by beaded corner 760 forms an emphasized edge along the joint between the building surface panels.

Figure 8:
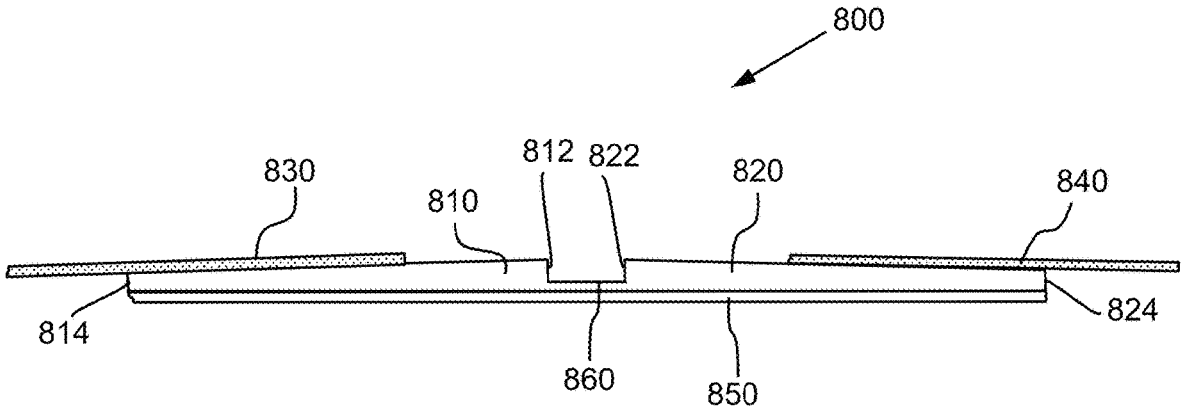
FIG. 8 is a schematic end view of a joint support according to another embodiment of the disclosure.

In certain embodiments of the joint support as otherwise described herein, the corner is a flexible hinge that connects the first elongate flange to the second elongate flange. Such a joint support is shown in FIG. 8. Joint support 800 includes first elongate flange 810, second elongate flange 820, first auxiliary flap 830, second auxiliary flap 840, and facing sheet 850. First and second elongate flanges 810, 820 are connected to one another by flexible hinge 860. Flexible hinge 860 allows joint support 800 to fit over a seam between building surface panels disposed at any angle to one another, including parallel panels.

In certain embodiments of the joint support as otherwise described herein, the flexible hinge is made of a same material as the first elongate flange and the second elongate flange. In other embodiments, the flexible hinge may be made of another material, for example, paper, metal, woven fabric, non-woven fabric, nylon or other materials appreciated by those of ordinary skill in the art.

In certain embodiments of the joint support as otherwise described herein, the flexible hinge is thinner than the first elongate flange and the second elongate flange. For example, the material that forms flexible hinge 860 is thinner than the material that forms first elongate flange 810 and second elongate flange 820.

In certain embodiments of the joint support as otherwise described herein, each of the first elongate flange and the second elongate flange has a thickness in a range from 0.25 mm to 3 mm, e.g., from 0.7 mm to 2.3 mm, e.g., from 0.9 mm to 1.7 mm. As described herein, the thickness of the first elongate flange and the second elongate flange is a measure of the thickest area of the respective flange across its width.

In certain embodiments of the joint support as otherwise described herein, the first elongate flange tapers so as to decrease in thickness toward the outer edge of the first elongate flange, and the second elongate flange tapers so as to decrease in thickness toward the outer edge of the second elongate flange. For example, first elongate flange 810 of joint support 800 is thicker near inner edge 812, where it is closer to flexible hinge 860, and tapers toward outer edge 814, where it is thinner. In some examples, the thickness of first elongate flange tapers down to a thickness in a range from 0.25 mm to 1 mm, e.g., from 0.5 mm to 0.8 mm. Similarly, second elongate flange 820 is also thicker near inner edge 822, where it is closer to flexible hinge 860, and tapers toward outer edge 824, where it is thinner. In some examples, the thickness of the second elongate flange tapers down to a thickness in a range from 0.25 mm to 1 mm, e.g., from 0.5 mm to 0.8 mm.

In certain embodiments of the joint support as otherwise described herein, the joint support is a rolled product. For example, the use of flexible hinge 860 permits joint support 800 to be formed as part of a rolled product for convenient storage and transport. For example, joint support 800 is configured to be rolled along its length during storage. Upon installation of joint support 800, it is unrolled to its elongate form before being applied over any building surface panels.

In certain embodiments of the joint support as otherwise described herein, the first elongate flange and the second elongate flange are disposed at an obtuse angle. For example, the first elongate flange may be disposed at an angle greater than 90° from the second elongate flange. This property allows the joint support to be placed on any two building surface panels disposed at a right angle from one another. Accordingly, after the joint support is placed on the two building surface panels, pressure is applied to the joint support to decrease the angle between the first elongate flange and the second elongate flange to a smaller angle that is equal to the angle of the adjacent building surface panels. The pressure sensitive adhesive substance then holds the first and second auxiliary flaps against the building surface panels at the reduced angle. In some embodiments, the first elongate flange and the second elongate flange are disposed at an angle in a range from 30° to 180°, e.g., from 45° to 150°, e.g., from 60° to 120°, e.g., from 80° to 100°, e.g., from 90° to 100°, e.g., from 91° to 95°.

In certain embodiments of the joint support as otherwise described herein, the facing sheet is a paper facing. In other embodiments of the joint support as otherwise described herein, the facing sheet is a fiber mat. Other materials, for example foam materials, sponges, and absorbent fabrics, may also be used for the facing sheet, as will be appreciated by those of ordinary skill in the art. Further, in some embodiments, the facing sheet is made of another material that can hold an amount of adhesive within the structure of the facing.

In certain embodiments of the joint support as otherwise described herein, each of the first elongate flange and the second elongate flange has a width in a range from ½ inch to 5 inches, e.g., from 1 inch to 3 inches, e.g., from 1.5 inches to 2 inches.

In certain embodiments of the joint support as otherwise described herein, the joint support further includes a first release liner disposed on an inside surface of the first auxiliary flap and a second release liner disposed on an inside surface of the second auxiliary flap. Such release liners serve to prevent unwanted adhesion of the pressure sensitive adhesive substance with a building surface. For example, in joint support 500, first release liner 582 is attached to the inside surface of first auxiliary flap 530 and second release liner 584 is attached to the inside surface of second auxiliary flap 540. Before applying the joint support to a building surface, the release liners are peeled off or otherwise removed from the inside surface of the first auxiliary flap and the inside surface of the second auxiliary flap so as to allow the pressure sensitive adhesive substance disposed on the inside surface of the first auxiliary flap and the inside surface of the second auxiliary flap to adhere to the building surface.

In certain embodiments of the joint support as otherwise described herein, the pressure sensitive adhesive substance is configured to transition from having a first adhesive strength to having a second adhesive strength upon application of a stimulus. In certain embodiments, the pressure sensitive adhesive substance is applied in a uniform distribution over the joint support. In other embodiments, the pressure sensitive adhesive is applied in a non-uniform distribution. In yet other embodiments, the pressure sensitive adhesive is applied in a dis-continuous fashion, such as in lines, stripes, dots or patterns. A distribution of adhesives in selected areas can have manufacturing and material efficiency benefits as will be appreciated by those of ordinary skill in the art.

In certain embodiments of the joint support as otherwise described herein, the first adhesive strength is configured to form a releasable adhesive bond between the joint support and a building surface. For example, the joint support may initially adhere to a building surface with a first adhesive strength that allows the joint support to form a releasable bond with the building surface. Such a releasable bond ensures that the joint support does not become permanently bonded with the building surface and allows movement of the joint support around the building surface. In examples, a releasable bond means that at least 80% (or at least 90%, or at least 95%) of the pressure sensitive adhesive substance disposed the inside surface of the joint support is maintained on the joint support after removing the joint support from the building surface on which the joint support is placed.

In certain embodiments of the joint support as otherwise described herein, the second adhesive strength is configured to form a permanent adhesive bond between the joint support and a building surface. For example, the joint support may adhere to a building surface with a second adhesive strength that allows the joint support to form a permanent bond with a building surface. Such a permanent bond ensures that the joint support becomes securely bonded with the building surface and prevents the movement of the joint support around the building surface. In examples, a permanent bond means that the removal of the joint support will result in damage of the building surface on which the joint support is placed. In other examples, a permanent bond means that removal of the joint support from the building surface results in loss of the pressure sensitive adhesive substance from the joint support, as the pressure sensitive adhesive substance is left on the building surface as the joint support is removed.

In certain embodiments of the joint support as otherwise described herein, the first adhesive strength is weaker than the second adhesive strength. For example, a releasable adhesive bond with a building surface is weaker than a permanent adhesive bond with the building surface. In such embodiments, the joint support is at least temporarily repositionable during installation, allowing for adjustment of its configuration, before it is firmly attached in its final position.

In certain embodiments of the joint support as otherwise described herein, the stimulus is an application of pressure. In such embodiments, the adhesive strength exhibited by the pressure sensitive adhesive substance depends on the amount of pressure applied on the joint support. That is, the greater the pressure applied on the joint support with respect to a building surface, the stronger the adhesive bond between the joint support and the building surface. In some embodiments, the pressure required to permanently adhere the joint support to a building surface (e.g., transition the joint support from having a releasable bond with the building surface to having a permanent bond with a building surface) is moderate, e.g., that applied by a builder, for example by hand or with a rolling tool. In other embodiments, the pressure required to permanently adhere a joint support to a building surface is large, e.g., tens to hundreds of psi, and can be applied by a specialized tool or a machine. As will be appreciated by those of skill in the art, the necessary pressure to cause the joint support to permanently adhere to a building surface can depend on the pressure sensitive adhesive substance formulation and other considerations such as the integrity of the building surface panels and the support strip of the joint support.

In certain embodiments of the joint support as otherwise described herein, the first auxiliary flap and second auxiliary flap are formed of paper. In other embodiments of the joint support as otherwise described herein, the first auxiliary flap and the second auxiliary flap are formed of plastic or another material. For example, in some embodiments the first auxiliary flap and the second auxiliary flap are formed of a fiber mat.

In certain embodiments of the joint support as otherwise described herein, the pressure sensitive adhesive substance is disposed on the inside surface of the outer portion of the first auxiliary flap and the inside surface of the outer portion of the second auxiliary flap. In other embodiments of the joint support as otherwise described herein, the pressure sensitive adhesive substance is disposed on the inside surface of the inner portion of the first auxiliary flap and the inside surface of the inner portion of the second auxiliary flap. In yet other embodiments of the joint support as otherwise described herein, the pressure sensitive adhesive substance is disposed on the inside surface of the outer portion of the first auxiliary flap, the inside surface of the inner portion of the first auxiliary flap, and the inside surface of the outer portion of the second auxiliary flap, and the inside surface of the inner portion of the second auxiliary flap.

In certain embodiments of the joint support as otherwise described herein, the joint support includes perforations therethrough. For example, joint support 500 includes perforations 572 that extend through facing sheet 550 and first elongate flange 510 and perforations 574 that extend through facing sheet 550 and second elongate flange 520. Perforations 572 and 574 allow a joint compound to extend through the joint support 500, which enhances the connection of the joint support 500 to any building surface panels on which it is secured.

In certain embodiments of the joint support as otherwise described herein, the perforations are positioned in sections of the joint support in which the first auxiliary flap and the second auxiliary flap are not disposed. For example, as shown in FIG. 5, perforations 572 occur in a section of joint support 500 in which first auxiliary flap 530 is not disposed and perforations 574 occur in a section of joint support 500 in which second auxiliary flap 540 is not disposed.

Figure 9:
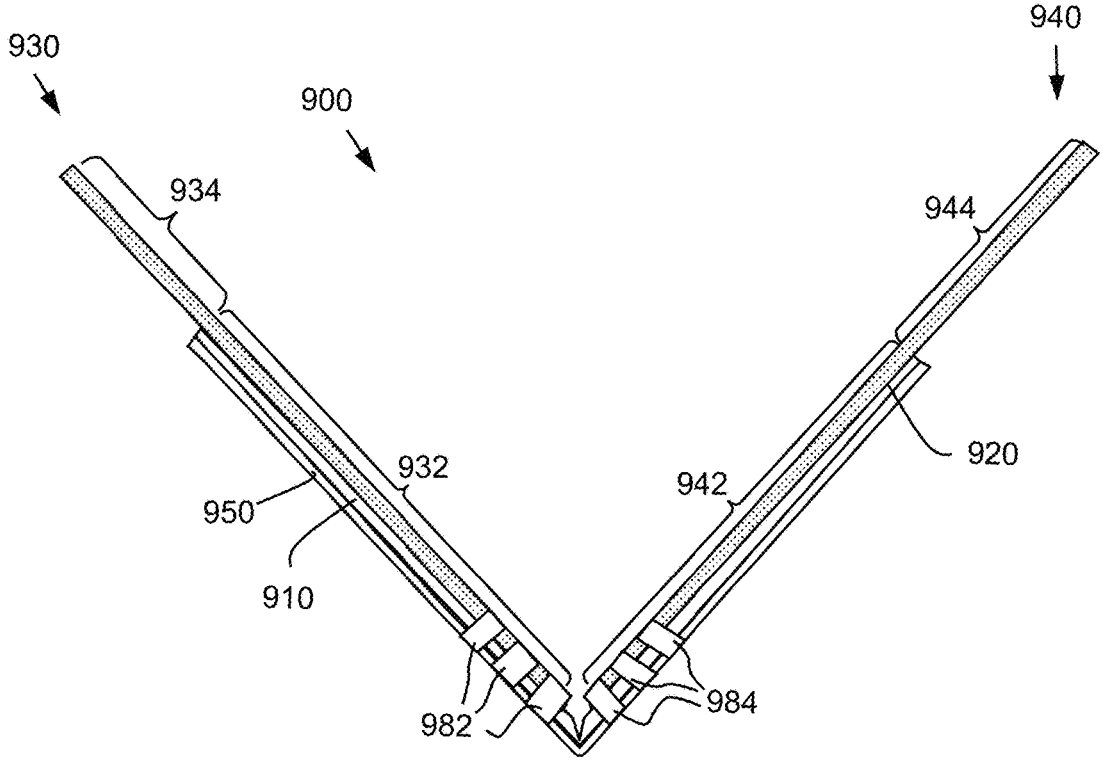
FIG. 9 is a schematic cross-sectional view of a joint support according to another embodiment of the disclosure.

In certain embodiments of the joint support as otherwise described herein, the joint support includes first perforations in sections of the joint support that coincide with the inner portion of the first auxiliary flap and the joint support includes second perforations in sections of the joint support that coincide with the inner portion of the second auxiliary flap. Such a joint support is shown in FIG. 9. Joint support 900 includes first elongate flange 910, second elongate flange 920, first auxiliary flap 930 attached to first elongate flange 910, second auxiliary flap 940 attached to second elongate flange 920, and facing sheet 950. First auxiliary flap 930 includes inner portion 932 and outer portion 934. Second auxiliary flap 940 includes inner portion 942 and outer portion 944. As shown, perforations 982 extend through facing sheet 950, first elongate flange 910, and inner portion 932 of first auxiliary flap 932 and perforations 984 extend through facing sheet 950, second elongate flange 920, and inner portion 942 of second auxiliary flap 940.

In certain embodiments of the joint support as otherwise described herein, the support strip is formed of plastic. For example, the support strip may include at least one of High Density Polyethylene (HDPE), Polyethylene Terephthalate (PET), Acrylonitrile Butadiene Styrene (ABS) copolymer, Acrylonitrile Styrene Acrylate (ASA) copolymer, Polyvinyl Chloride (PVC), PETG, high-impact polystyrene (HIPS), Polycarbonate (PC), Polylactic Acid (PLA), or Polyester. In certain embodiments of the joint support as otherwise described herein, the support strip is reinforced with a fibrous material. For example, in some embodiments, the support strip is reinforced with glass fibers. In other embodiments, the support strip is reinforced with cellulous or other fibers. In other embodiments of the joint support as otherwise described herein, the support strip is formed of metal. For example, in some embodiments, the support strip of the support strip is formed of steel. In other embodiments, the support strip is formed of aluminum or an aluminum alloy.

In certain embodiments of the joint support as otherwise described herein, the joint support is a corner bead. For example, joint support 100, shown in FIGS. 1A and 1B, is a corner bead that is configured to cover a joint between two panels that meet at a corner of a building surface.

In certain embodiments of the joint support as otherwise described herein, the length of the joint support is in a range from 4 feet to 20 feet, e.g., from 6 feet to 15 feet, e.g., from 8 feet to 12 feet.

A variety of pressure sensitive adhesives are suitable for use in the joint supports and methods of the disclosure. Pressure sensitive adhesives are typically based on an elastomeric material, often with a tackifier to provide stickiness. In certain embodiments of the joint support as otherwise described herein, the pressure sensitive adhesive substance is based on an acrylic polymer, e.g., based on one or more acrylate or methacrylate monomers such as acrylic acid, isobutyl acrylate, n-propyl acrylate, n-butyl acrylate, ethyl acrylate, isopropyl acrylate, 2-ethylhexyl acrylate, lauryl acrylate, lauryl methacrylate, isodecyl acrylate, isooctyl acrylate, tridecyl methacrylate, tridecyl acrylate, 2-ethylhexyl methacrylate, and caprolactone acrylate. Other suitable systems can include epoxy resins, polyvinyl acetate, ethylene-vinyl acetate copolymer (e.g., with high vinyl acetate content); butyl rubbers, natural rubbers, nitriles, silicone rubbers, polyurethane, styrene-butadiene rubbers, styrene-isoprene rubbers, styrene block copolymers like styrene-butadiene-styrene (SBS), styrene-ethylene/butylene-styrene (SEBS), styrene-ethylene/propylene (SEP), and styrene-isoprene-styrene (SIS). A variety of tackifiers can be used, depending on the elastomer, e.g., resins (e.g. rosins and their derivates, terpenes and modified terpenes, aliphatic, cycloaliphatic and aromatic resins, hydrogenated hydrocarbon resins, and their mixtures, terpene-phenol resins (especially with ethylene-vinyl acetate adhesives)), novolacs, silicone tackifiers based on so-called "MQ" silicate resins (based on monofunctional trimethylsilane reacted with silicon tetrachloride, especially for silicone rubbers). Many other adhesives and adhesive precursors are known in the art with different modes of operation and may be used as the pressure sensitive adhesive substance. The pressure sensitive adhesive substance can be selected to provide compatibility with the other materials and provide a necessary amount of strength to bond with a building surface.

In certain embodiments of the joint support as otherwise described herein, the pressure sensitive adhesive substance includes a temperature-induced phase change material. In certain embodiments, this material serves to structurally or chemically stabilize the pressure sensitive adhesive substance unless the temperature is raised to a certain point, at which the phase change occurs and the stabilization removed. In some embodiments, the phase change material rigidly prevents components of the pressure sensitive adhesive substance from reacting chemically. In some embodiments, the phase change material acts as a solvent upon melting. Examples of such materials include n-docosane, n-eicosane, n-heneicosane, n-heptacosane, n-heptadecane, n-hexacosane, n-hexadecane, n-nonadecane, n-octasane, n-octadecane, n-pentacosane, n-pentadecane, n-tetracosane, n-tetradecane, n-tricosane, and n-tridecane. More generally, any material that undergoes a change in phase within a useful temperature range is desirable and may be included as a component of the pressure sensitive adhesive substance.

In certain embodiments of the joint support as otherwise described herein, the pressure sensitive adhesive substance includes a stabilizing agent. In certain embodiments, stabilizing agents serve to prevent unwanted reactivity during manufacture, storage, or installation of the pressure sensitive adhesive substance. In some embodiments, stabilizing agents also guard against accidental exposure to light, heat, or oxygen that would otherwise serve to degrade the performance of the pressure sensitive adhesive substance. Examples of useful stabilizing agents that are included as a component of the pressure sensitive adhesive substance include certain plastic materials such as 2,2-dimethyloyl-1,3-propanediol and 2-hydroxymethyl-2-methyl-1,3-propandiol and the like.

In another aspect, the disclosure provides a building surface construction including a first building surface panel and a second building surface panel adjacent to the first building surface panel so as to form a seam between the first building surface panel and second building surface panel. A joint support is disposed over the first building surface panel and the second building surface panel and covers at least a portion of the seam. The joint support is secured to the first building surface panel and the second building surface panel by means of a pressure sensitive adhesive substance disposed on the inside surface of the joint support, as described above. The joint support may include any of the features of the joint supports as described above.

Figure 10:
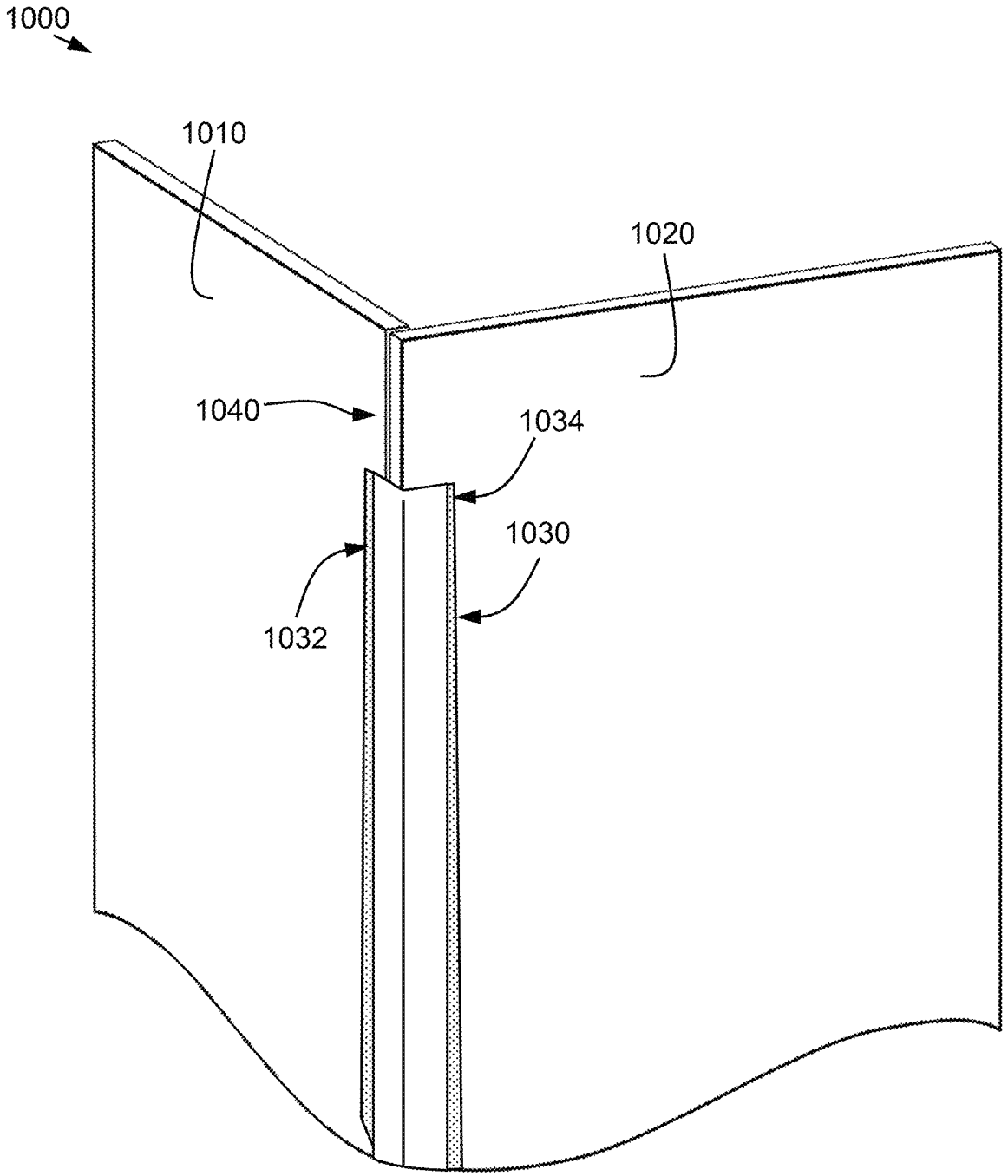
FIG. 10. is a schematic perspective view of a building surface construction according to an embodiment of the disclosure.

Such a building construction is shown in perspective view in FIG. 10. Building construction 1000 includes first building surface panel 1010 and second building surface panel 1020. Joint support 1030 is placed over an edge of a first building panel 1010 and an edge of a second building panel 1020 so as to cover a portion of a seam 1040 between the two building surface panels. In the depicted embodiment, joint support 1030 is positioned at a distance from the upper edges of first building panel 1010 and second building panel 1020. However, in other embodiments, the joint support extends to the edge of the panels and the portion of the seam that is covered is the entire seam. Further, joint support 1030 includes first auxiliary flap 1032 and second auxiliary flap 1034. The inside surface of both first auxiliary flap 1032 and second auxiliary flap 1034 includes a pressure sensitive adhesive substance that enables joint support 1030 to adhere to first building surface panel 1010 and second building surface panel 1020.

In certain embodiments of the building surface construction as otherwise described herein, the first and second building surface panels are drywall panels. In other embodiments, the building surface panels have other forms, such as cement boards or concrete panels. For example, in some embodiments, each of the building surface panels is a panel that includes a gypsum core surrounded by a facing material, such as a paper facing.

In certain embodiments of the building surface construction as otherwise described herein, the first building surface panel and the second building surface panel are disposed at an angle of about 90°, e.g., in a range from 87° to 93° degrees. In other embodiments of the joint support as otherwise described herein, the first building surface panel and the second building surface panel are disposed at an angle in a range from 30° (e.g., acute) to 180° (e.g., flat), e.g., from 45° to 150°, e.g., from 60° to 120°, e.g., from 80° to 100°.

In certain embodiments of the building surface construction as otherwise described herein, the building surface construction further includes a joint compound coating an outer surface of the facing sheet of the joint support. In some embodiments, the joint compound is spread out over the joint support and extends laterally beyond the edges of the joint support over the surfaces of the first and second building surface panels. The inclusion of such a joint compound coating on the outer surface of the facing sheet provides for a smooth transition between the joint support and the building surface panels.

In certain embodiments of the building surface construction as otherwise described herein, the building surface construction further includes a layer of paint covering the joint compound. The paint obscures the joint support and, in some embodiments, provides a continuous texture over the building surface construction across both the building surface panels and the joint support.

In certain embodiments of the building surface construction as otherwise described herein, the inside surface of the first auxiliary flap covers the outside surface of the first building surface panel and the inside surface of the second auxiliary flap covers the outside surface of second building surface panel. For example, the inside surface of first auxiliary flap 1032 is disposed over the outside surface of first building surface panel 1010 at the edge near second building surface panel 1020. Further, first auxiliary flap 1032 is adhered to the outside surface of first building surface panel 1010 using the pressure sensitive adhesive substance. Likewise, the inside surface of second auxiliary flap 1034 is disposed over the outside surface of second building surface panel 1020 at the edge near first building surface panel 1010. Further, second auxiliary flap 1034 is adhered to the outside surface of second building surface panel 1020 also using the pressure sensitive adhesive substance.

Figure 11:
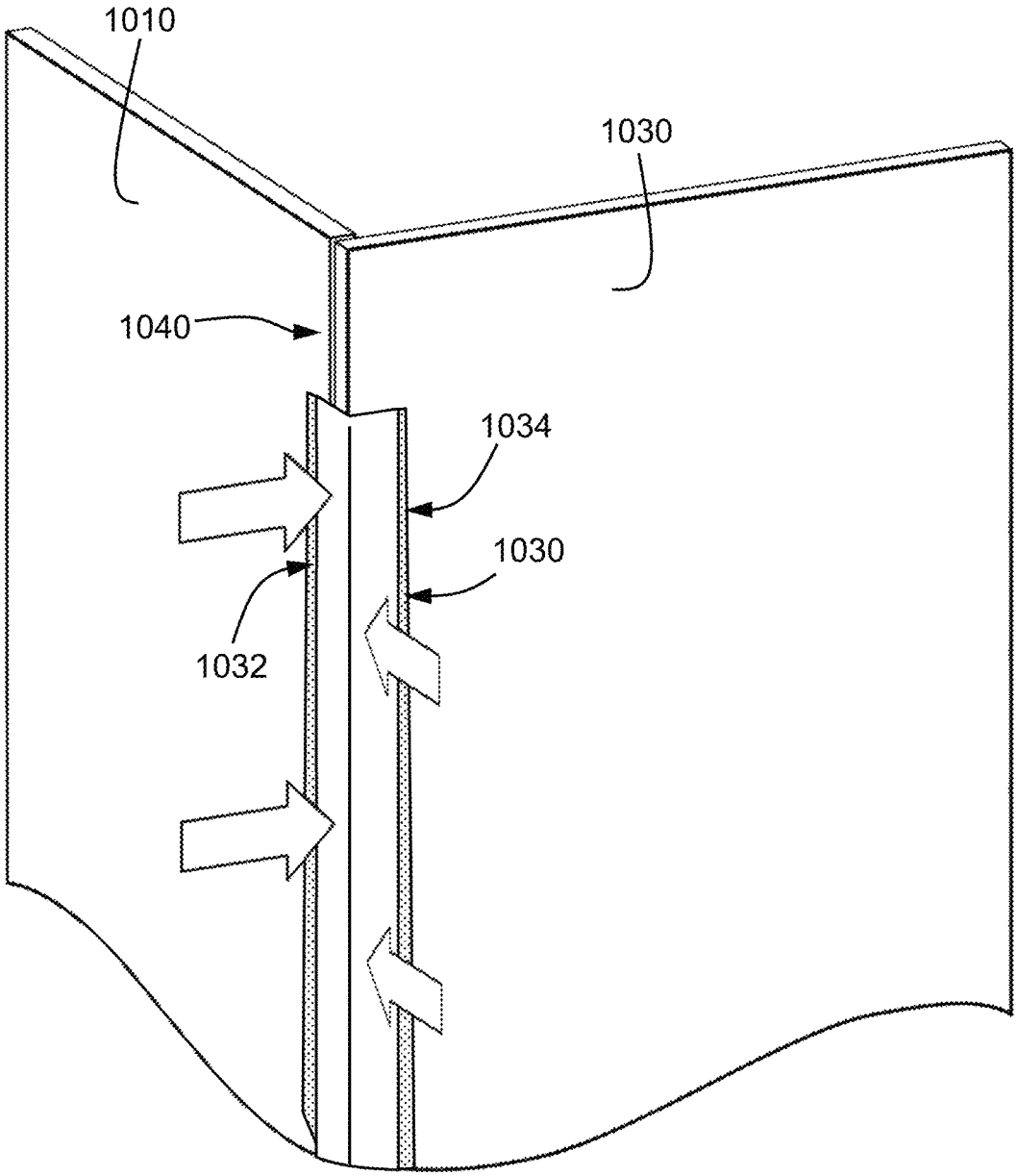
FIG. 11 is a schematic perspective view of a step in a method of securing a joint support to building surface panels according to an embodiment of the disclosure.
Figure 12:
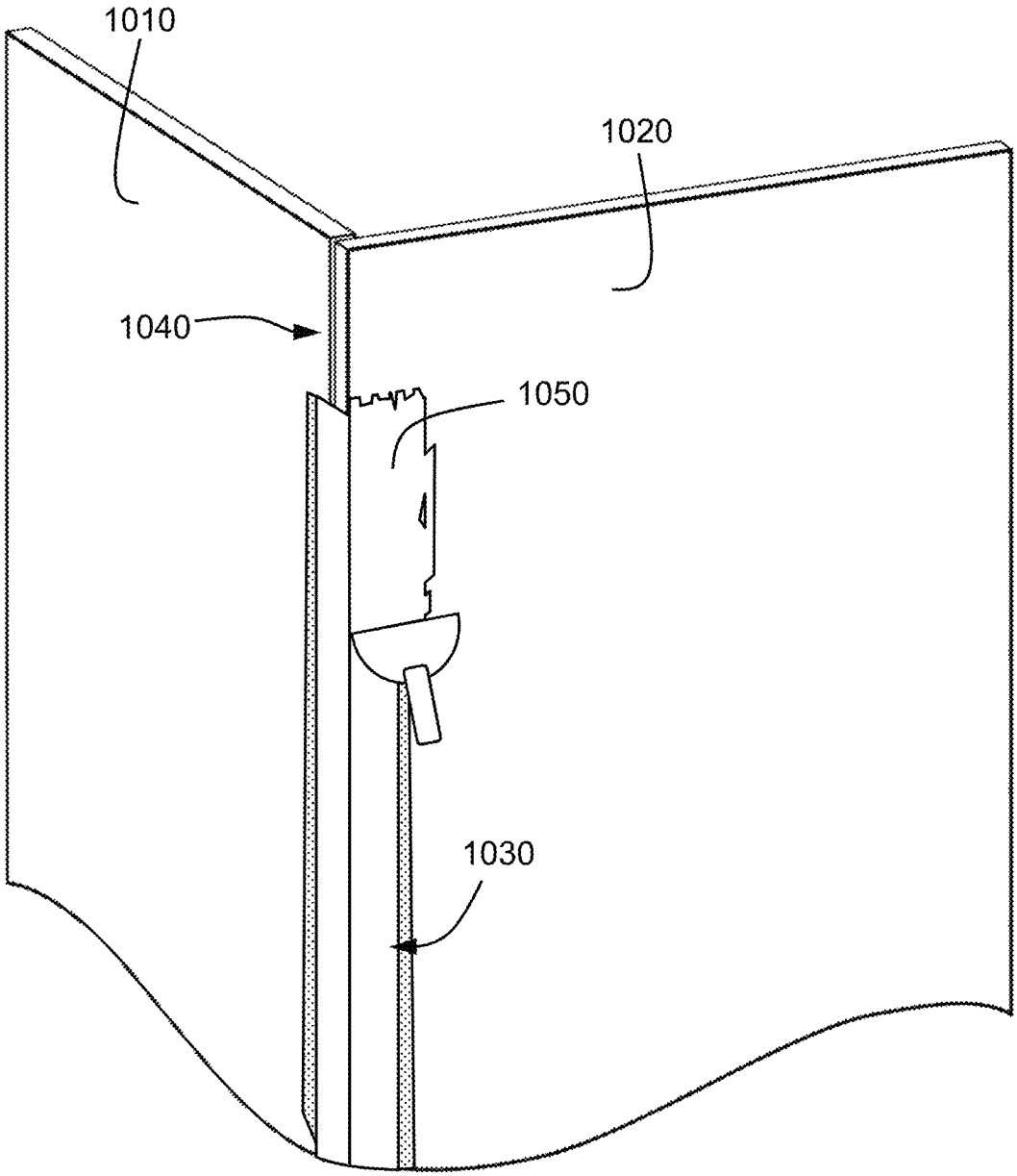
FIG. 12 is a schematic perspective view of another step in the method of FIG. 11.
Figure 13:
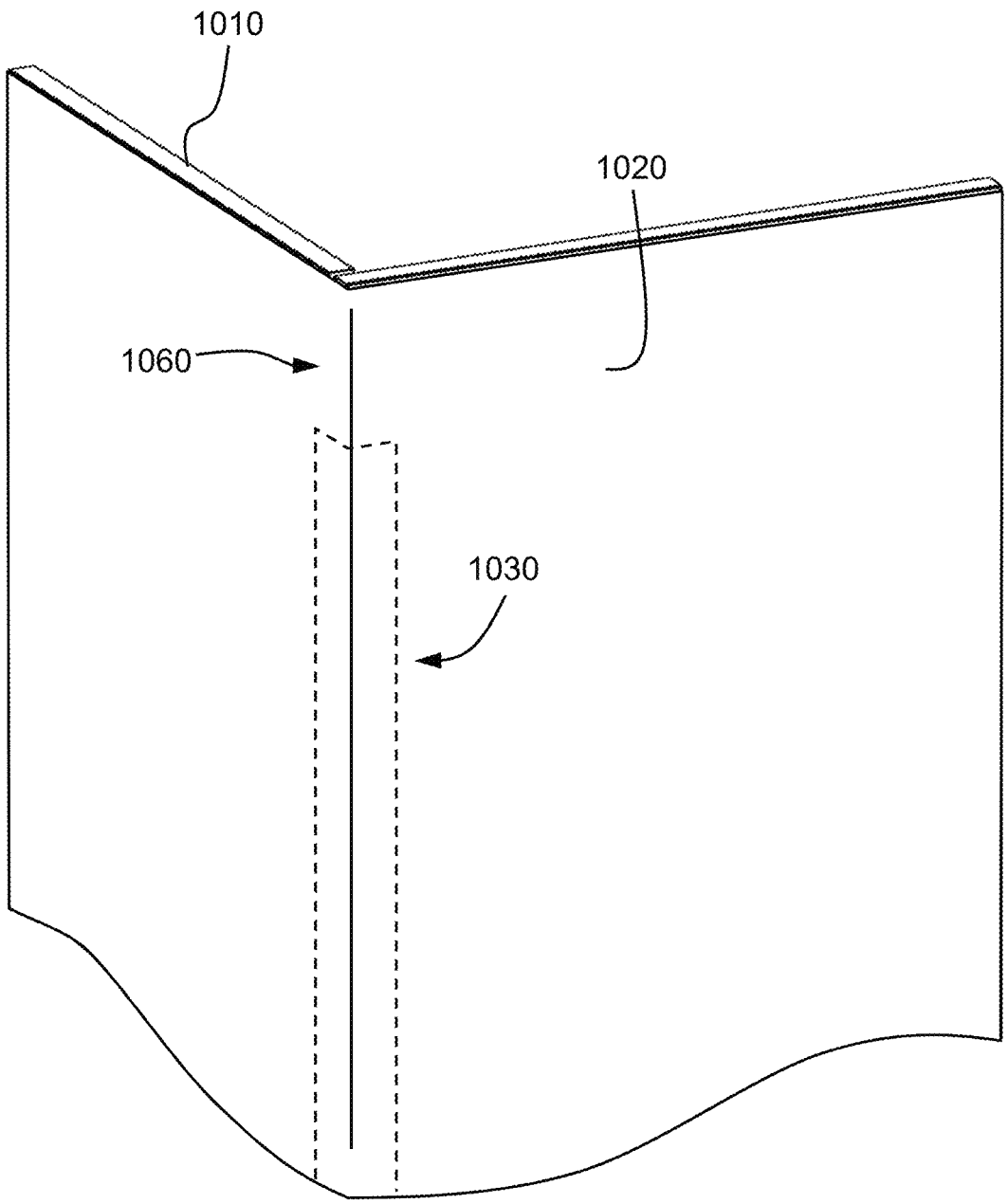
FIG. 13 is a schematic perspective view of yet another step in the method of FIG. 11.

In another aspect, the disclosure provides a method of installing a joint support according to the disclosure above on the building surface construction according to the disclosure above. Such a method is schematically depicted in FIGS. 11, 12, and 13. The method includes placing the joint support over the first building surface panel and the second building surface panel so as to cover a portion of a seam between the first and second building surface panels, where the inside surface of the first auxiliary flap is adjacent to an outside surface of the first building surface panel and where the inside surface of the second auxiliary flap is adjacent to an outside surface of the second building surface panel. The method also includes applying a stimulus to the joint support in order secure the joint support to the first and second building surface panels using the pressure sensitive adhesive.

In certain embodiments of the method as otherwise described herein, the stimulus is an application of pressure. For example, FIG. 11 schematically depicts joint support 1030 being pressed against the corner formed by first building surface panel 1010 and second building surface panel 1020. As set forth above, in some embodiments, the pressure is applied directly by a builder, for example by hand or with a rolling a tool, while in other embodiments, the pressure is applied by a specialized tool or is applied by a machine.

In certain embodiments of the method as otherwise described herein, the method further includes coating the outer surface of the paper facing of the joint support with a joint compound. Such a step is schematically depicted in FIG. 12, where a coating of joint compound 1050 is provided over a portion of joint support 1030 and second building surface panel 1020.

In certain embodiments of the method as otherwise described herein, the method further includes covering the joint compound with a layer of paint. For example, as shown in FIG. 13, in a further step, joint support 1030 is covered by a layer of paint 1060. The painted joint forms a clean and sharp corner over the seam of the building surface panels.

In certain embodiments of the method as otherwise described herein, the joint support is placed over the first and second building surface panels before the stimulus is applied to the joint support.

In certain embodiments of the method as otherwise described herein, the stimulus is initially applied to the inner portion of the first auxiliary flap and the inner portion of the second auxiliary flap and then applied to outer portion of the first auxiliary flap and the outer portion of the second auxiliary flap. This ensures that the joint support fits properly over the building surface and prevents wrinkles and ridges from forming on the joint support upon application.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

EMBODIMENTS

Embodiment 1. A joint support comprising:

a support strip having a length that extends from a first end to a second end, the support strip comprising:

first and second elongate flanges, each of the first and second elongate flanges extending from the first end to the second end and having an inside surface, an outside surface, an inner edge, and an outer edge;

a first auxiliary flap including an inner portion attached to the inside surface of the first elongate flange and an outer portion that extends laterally beyond the outer edge of the first elongate flange;

a facing sheet disposed on the outside surface of the first elongate flange and the outside surface of the second elongate flange; and a pressure sensitive adhesive substance disposed on at least a first portion of an inside surface of the first auxiliary flap.

Embodiment 2. The joint support according to embodiment 1, wherein the support strip includes a corner connecting the first elongate flange and the second elongate flange.

Embodiment 3A. The joint support according to embodiment 1 or 2 wherein the joint support includes a second auxiliary flap including an inner portion attached to the inside surface of the second elongate flange and an outer portion that extends laterally beyond the outer edge of the second elongate flange, and wherein the pressure sensitive adhesive substance is disposed on at least a portion of an inside surface of the second auxiliary flap.

Embodiment 3B. The joint support according to embodiment 3, wherein the inner portion of the first auxiliary flap and the inner portion of the second auxiliary flap connect at the corner.

Embodiment 4. The joint support according to embodiment 3, wherein the inner portion of the first auxiliary flap is spaced at least 1 inch from the corner and wherein the inner portion of the second auxiliary flap is spaced at least 1 inch from the corner.

Embodiment 5. The joint support according to any of embodiments 2 to 4, wherein the corner is a sharp corner that connects the first elongate flange to the second elongate flange and wherein a groove is disposed on an inside surface of the sharp corner.

Embodiment 6. The joint support according to any of embodiments 2 to 4, wherein the corner is a rounded corner connecting the first elongate flange and the second elongate flange so as to form a bull-nose corner bead.

Embodiment 7. The joint support according to any of embodiments 2 to 4, wherein the corner is a flexible hinge that connects the first elongate flange to the second elongate flange.

Embodiment 8. The joint support according to embodiment 7, wherein the flexible hinge is made of a same material as the first elongate flange and the second elongate flange.

Embodiment 9. The joint support according to embodiment 7 or embodiment 8, wherein the flexible hinge is thinner than the first elongate flange and the second elongate flange.

Embodiment 10. The joint support of any of embodiments 1 to 9, wherein each of the first elongate flange and the second elongate flange has a thickness in a range from 0.25 mm to 3 mm, e.g., from 0.25 mm to 1 mm, e.g., from 0.5 mm to 0.8 mm.

Embodiment 11. The join support according to any of embodiments 1 to 10, wherein the first elongate flange tapers so as to decrease in thickness toward the outer edge of the first elongate flange, and wherein the second elongate flange tapers so as to decrease in thickness toward the outer edge of the second elongate flange.

Embodiment 12. The joint support according to any of embodiments 1 to 11, wherein the first elongate flange and the second elongate flange are disposed at an obtuse angle.

Embodiment 13. The joint support according to any of embodiments 1 to 11, wherein the first elongate flange and the second elongate flange are disposed at an angle in a range from 80° to 100°, e.g., from 91° to 95°.

Embodiment 14. The joint support according to any of embodiments 1 to 13, wherein the facing sheet is a paper facing.

Embodiment 15. The joint support according to any of embodiments 1 to 14, wherein each of the first elongate flange and the second elongate flange has a width in a range from ½ inch to 5 inches, e.g., from 1 inch to 3 inches, e.g., from 1.5 inches to 2 inches.

Embodiment 16. The joint support according to any of embodiments 1 to 15, further comprising a first release liner disposed on an inside surface of the first auxiliary flap and a second release liner disposed on an inside surface of the second auxiliary flap.

Embodiment 17. The joint support according to any of embodiments 1 to 16, wherein the pressure sensitive adhesive substance is configured to transition from having a first adhesive strength to having a second adhesive strength upon application of a stimulus.

Embodiment 18. The joint support according to embodiment 17, wherein the stimulus is an application of pressure.

Embodiment 19. The joint support according to embodiment 17 or embodiment 18, wherein the first adhesive strength is weaker than the second adhesive strength.

Embodiment 20. The joint support according to any of embodiments 17 to 19, wherein the first adhesive strength is configured to form a releasable adhesive bond between the joint support and a building surface.

Embodiment 21. The joint support according to any of embodiments 17 to 20, wherein the second adhesive strength is configured to form a permanent adhesive bond between the joint support and a building surface.

Embodiment 22. The joint support according to any of embodiments 1 to 21, wherein the first auxiliary flap and the second auxiliary flap are formed of paper.

Embodiment 23. The joint support according to any of embodiments 1 to 22, wherein the pressure sensitive adhesive substance is disposed on an inside surface of the outer portion of the first auxiliary flap.

Embodiment 24. The joint support according to any of embodiments 1 to 23, further comprising:

first perforations in sections of the joint support that coincide with the inner portion of the first auxiliary flap, and second perforations in sections of the joint support that coincide with the inner portion of the second auxiliary flap.

Embodiment 25. The joint support according to any of embodiments 1 to 24, wherein the support strip is formed of plastic.

Embodiment 26. The joint support according to embodiment 25, wherein the support strip includes at least one of High Density Polyethylene (HDPE), Polyethylene Terephthalate (PET), Acrylonitrile Butadiene Styrene (ABS) copolymer, Acrylonitrile Styrene Acrylate (ASA) copolymer, Polyvinyl Chloride (PVC), PETG, high-impact polystyrene (HIPS), Polycarbonate (PC), Polylactic Acid (PLA), or Polyester.

Embodiment 27. The joint support according to any of embodiments 1 to 26, wherein the joint support is a corner bead.

Embodiment 28. The joint support according to any of embodiments 1 to 27, wherein the length is in a range from 4 feet to 20 feet, e.g., from 6 feet to 15 feet, e.g., from 8 feet to 12 feet.

Embodiment 29. The joint support according to any of embodiments 1 to 28, wherein the pressure sensitive adhesive substance includes at least one polymer selected from acrylic polymers, e.g., based on one or more acrylate or methacrylate monomers such as acrylic acid, isobutyl acrylate, n-propyl acrylate, n-butyl acrylate, ethyl acrylate, isopropyl acrylate, 2-ethylhexyl acrylate, lauryl acrylate, lauryl methacrylate, isodecyl acrylate, isooctyl acrylate, tridecyl methacrylate, tridecyl acrylate, 2-ethylhexyl methacrylate, and caprolactone acrylate, epoxy resins, polyvinyl acetate, ethylene-vinyl acetate copolymers (e.g., with high vinyl acetate content); butyl rubbers, natural rubbers, nitriles, silicone rubbers, polyurethane, styrene-butadiene rubbers, styrene-isoprene rubbers, and styrene block copolymers like styrene-butadiene-styrene (SBS), styrene-ethylene/butylene-styrene (SEBS), styrene-ethylene/propylene (SEP), and styrene-isoprene-styrene (SIS).

Embodiment 30. The joint support according to any of embodiments 1 to 29, wherein the joint support is a rolled product.

Embodiment 31. A building surface construction using the joint support of any of embodiments 1 to 30, the building surface construction comprising:

a first building surface panel;

a second building surface panel adjacent to the first building surface panel so as to form a seam between the first building surface panel and the second building surface panel; and the joint support disposed over the first building surface panel and the second building surface panel and covering at least a portion of the seam, wherein the pressure sensitive adhesive substance secures the joint support to the first and second building surface panels.

Embodiment 32. The building surface construction according to embodiment 31, wherein the first and second building surface panels are drywall panels.

Embodiment 33. The building surface construction according to embodiment 31 or 32, wherein the first building surface panel and the second building surface panel are disposed at an angle of about 90°.

Embodiment 34. The building surface construction of any of embodiments 31 to 33, further comprising a joint compound coating an outer surface of the facing sheet of the joint support.

Embodiment 35. The building surface construction according to embodiment 34, further comprising a layer of paint covering the joint compound.

Embodiment 36. The building surface construction according to any of embodiments 31 to 35, wherein the inside surface of first auxiliary flap is disposed over an outside surface of first building surface panel and the inside surface of second auxiliary flap covers an outside surface of second building surface panel.

Embodiment 37. A method of installing the joint support according to any of embodiments 1 to 30 so as to form the building surface according to any of embodiments 31 to 36, the method comprising:

placing the joint support over the first building surface panel and the second building surface panel so as to cover at least a portion of a seam between the first and second building surface panels, wherein the inside surface of the first auxiliary flap is adjacent to an outside surface of the first building surface panel, and wherein the inside surface of the second auxiliary flap is adjacent to an outside surface of the second building surface panel;

applying a stimulus to the joint support in order to secure the joint support to the first and second building surface panels using the pressure sensitive adhesive.

Embodiment 38. The method according to embodiment 37, wherein the stimulus is an application of pressure.

Embodiment 39. The method according to embodiment 37 or embodiment 38, further comprising coating the outer surface of the facing sheet of the joint support with a joint compound.

Embodiment 40. The method according to any of embodiments 37 to 39, further comprising covering the joint compound with a layer of paint.

Embodiment 41. The method according to any of embodiments 37 to 40, wherein the joint support is placed over the first and second building surface panels before the stimulus is applied to the joint support.

Embodiment 42. The method according to any of embodiments 37 to 41, wherein the stimulus is initially applied to the inner portion of the first auxiliary flap and the inner portion of the second auxiliary flap and then applied to outer portion of the first auxiliary flap and the outer portion of the second auxiliary flap.

The invention claimed is:

1. A joint support comprising:

a support strip having a length that extends from a first end to a second end, the support strip comprising:

first and second elongate flanges, each of the first and second elongate flanges extending from the first end to the second end and having an inside surface, an outside surface, an inner edge, and an outer edge, and a corner connecting the first elongate flange and the second elongate flange;

a first auxiliary flap including an inner portion attached to the inside surface of the first elongate flange and an outer portion that extends laterally beyond the outer edge of the first elongate flange;

a facing sheet disposed on the outside surface of the first elongate flange and the outside surface of the second elongate flange;

a pressure sensitive adhesive substance disposed on at least a first portion of an inside surface of the first auxiliary flap; and a release liner disposed on an inside surface of the pressure sensitive adhesive, wherein the pressure sensitive adhesive substance is configured to transition from having a first adhesive strength configured to form a releasable adhesive bond between the joint support and a building surface to having a second adhesive strength upon application of pressure, the second adhesive strength configured to form a permanent adhesive bond between the joint support and the building surface.

2. The joint support according to claim 1, having a length in a range from 4 feet to 20 feet.

3. The joint support according to claim 1, further comprising a second auxiliary flap including an inner portion attached to the inside surface of the second elongate flange and an outer portion that extends laterally beyond the outer edge of the second elongate flange, wherein the pressure sensitive adhesive is further disposed on an inside surface of the second auxiliary flap.

4. The joint support according to claim 1, having a length of at least 4 feet.

5. A method of installing a joint support to provide a building surface construction comprising:

a first building surface panel;

a second building surface panel adjacent to the first building surface panel so as to form a seam between the first building surface panel and the second building surface panel; and a joint support comprising:

a support strip having a length that extends from a first end to a second end, the support strip comprising:

first and second elongate flanges, each of the first and second elongate flanges extending from the first end to the second end and having an inside surface, an outside surface, an inner edge, and an outer edge, and a corner connecting the first elongate flange and the second elongate flange;

a first auxiliary flap including an inner portion attached to the inside surface of the first elongate flange and an outer portion that extends laterally beyond the outer edge of the first elongate flange;

a facing sheet disposed on the outside surface of the first elongate flange and the outside surface of the second elongate flange; and a pressure sensitive adhesive substance disposed on at least a first portion of an inside surface of the first auxiliary flap, the joint support being disposed over the first building surface panel and the second building surface panel and covering at least a portion of the seam, wherein the pressure sensitive adhesive substance secures the first auxiliary flap of the joint support to the first building surface panel, the method comprising:

providing the joint support, wherein the pressure sensitive adhesive substance is configured to transition from having a first adhesive strength configured to form a releasable adhesive bond between the joint support and a building surface to having a second adhesive strength upon application of pressure, the second adhesive strength configured to form a permanent adhesive bond between the joint support and the building surface, and wherein the joint support is provided with a release liner disposed on an inside surface of the pressure sensitive adhesive substance;

removing the release liner to expose the pressure sensitive adhesive substance; then placing the joint support over the first building surface panel and the second building surface panel so as to cover at least a portion of the seam between the first and second building surface panels and to adhere the inside surface of the first auxiliary flap to an outside surface of the first building surface panel via the pressure sensitive adhesive substance with a releasable adhesive bond; and then applying pressure to the joint support to adhere the inside surface of the first auxiliary flap to an outside surface of the first building surface panel via the pressure sensitive adhesive substance with a permanent adhesive bond.

6. The method according to claim 5, wherein the corner is a flexible hinge that connects the first elongate flange to the second elongate flange.

7. The method according to claim 5, wherein the first elongate flange tapers so as to decrease in thickness toward the outer edge of the first elongate flange, and wherein the second elongate flange tapers so as to decrease in thickness toward the outer edge of the second elongate flange.

8. The method according to claim 5, wherein the facing sheet is a paper facing.

9. The method according to claim 5, wherein the first auxiliary flap is formed of paper.

10. The method according to claim 5, wherein the support strip is formed of plastic.

11. The method according to claim 5, wherein the joint support is a corner bead.

12. The method according to claim 5, wherein the first and second building surface panels are drywall panels.

13. The method according to claim 5, wherein the first building surface panel and the second building surface panel are disposed at an angle of about 90°.

14. The method according to claim 5, further comprising coating the outer surface of the facing sheet of the joint support with a joint compound.

15. The method according to claim 5, further comprising covering the joint compound with a layer of paint.

16. The method according to claim 5, wherein the pressure is initially applied to the inner portion of the first auxiliary flap and then applied to outer portion of the first auxiliary flap.

17. The method according to claim 5, wherein the corner is a flexible hinge that connects the first elongate flange to the second elongate flange, and wherein the placing comprises flexing the flexible hinge so that the first elongate flange is disposed against the first building panel and the second elongate flange is disposed against the second building panel.

18. The method of claim 17, wherein the flexing of the flexible hinge comprises flexing the flexible hinge so that the first elongate flange and the second elongate flange are disposed at an angle in a range from 45° to 150°.

19. The method of claim 5, wherein the joint support has a length in the range of 6 feet to 15 feet.

20. The method of claim 5, wherein the joint support further comprises a second auxiliary flap including an inner portion attached to the inside surface of the second elongate flange and an outer portion that extends laterally beyond the outer edge of the second elongate flange, wherein the pressure sensitive adhesive is further disposed on an inside surface of the second auxiliary flap, the joint support is placed over the first building surface panel and the second building surface panel so as to adhere the inside surface of the second auxiliary flap to an outside surface of the second building surface panel via the pressure sensitive adhesive substance with a releasable adhesive bond; and the application of pressure to the joint support adheres the inside surface of the second auxiliary flap to the outside surface of the second building surface panel via the pressure sensitive adhesive substance with a permanent adhesive bond.

21. The method of claim 5, further comprising, after the placing of the joint support so as to adhere the inside surface of the first auxiliary flap to the outside surface of the first building surface panel with a releasable adhesive bond and before applying pressure to the joint support in order to adhere the inside surface of the first auxiliary flap to an outside surface of the first building surface panel with a permanent adhesive bond, releasing the releasable bond and adjusting a position of the joint support on the outside surface of the first building surface panel.

* * * * *